United States Patent [19]

Lytton et al.

[11] Patent Number: 5,025,532

[45] Date of Patent: Jun. 25, 1991

[54] FIBER BALE OPENER HAVING TWO OPENING CHAMBERS

[75] Inventors: Kenneth G. Lytton, Gastonia, N.C.; Odell F. Bolin, Clover, S.C.; Robert J. Koehler, Gastonia, N.C.

[73] Assignee: Fiber Controls Corporation, Gastonia, N.C.

[21] Appl. No.: 496,315

[22] Filed: Mar. 20, 1990

[51] Int. Cl.[5] ..... D01G 7/12

[52] U.S. Cl. ..... 19/80 R

[58] Field of Search ..... 19/80 R; 439/11, 12, 439/13, 18, 195

[56] References Cited

U.S. PATENT DOCUMENTS

| | | | |
|---|---|---|---|
| 3,076,068 | 1/1963 | Racklyelt | 439/195 X |
| 3,181,715 | 5/1965 | Olson | 439/12 X |
| 3,434,092 | 3/1969 | Brown et al. | 439/195 |
| 4,195,954 | 4/1980 | Bentzen-Bilkvist et al. . | |
| 4,467,502 | 8/1984 | Lytton et al. . | |
| 4,557,021 | 12/1985 | Nash et al. | 19/80 R |
| 4,595,149 | 6/1986 | Hergeth . | |
| 4,623,099 | 11/1986 | Vosbein et al. | 19/80 R X |
| 4,712,275 | 12/1987 | Hösel et al. | 19/80 R |
| 4,747,187 | 5/1988 | Leifeld | 19/80 R |
| 4,780,933 | 11/1988 | Pinto et al. | 19/80 R |
| 4,785,504 | 11/1988 | Leifeld et al. . | |
| 4,796,335 | 1/1989 | Kranefeld . | |
| 4,903,374 | 2/1990 | Hösel | 19/80 R |

FOREIGN PATENT DOCUMENTS

| | | | |
|---|---|---|---|
| 0478559 | 11/1969 | Switzerland | 439/18 |
| 475757 | 6/1975 | U.S.S.R. | 439/18 |

*Primary Examiner*—Werner H. Schroeder
*Assistant Examiner*—John J. Calvert
*Attorney, Agent, or Firm*—Cushman, Darby & Cushman

[57] ABSTRACT

A circular textile fiber bale opener with a goosenecked transition from separately chambered dual plucker rolls provide for larger laydown area and greater production. The transition causes uniform air velocity at the top of the fiber bales across the full length of the plucker rolls. Plucked fibers from the transition are delivered through a centrally disposed hollow shaft for delivery downstream. The shaft carries electrical collector rings with which are associated brushes which rotate with the opener for completing connections between the external and internal wiring required for the apparatus.

19 Claims, 4 Drawing Sheets

FIBER BALE OPENER HAVING TWO OPENING CHAMBERS

This invention relates to a textile fiber bale opener of the type having rotary beater equipment which extends in a radial direction while rotatingly sweeping an annular area in which bales of textile fibers are disposed, for the purpose of plucking fibers therefrom and passing them on to subsequent textile processing equipment.

BACKGROUND OF THE INVENTION

The present invention is an improvement on the equipment in U.S. Pat. No. 4,467,502 which describes and claims such a rotary fiber bale opener, and the contents of that patent are incorporated hereinto by reference to the extent not inconsistent with the disclosure set forth herein.

Equipment made in accordance with that prior patent has been quite successful, but as higher and higher processing rates are required by equipment which it feeds, improvements became necessary.

In particular, the annular area in which bales were disposed could not hold enough bales for the large volume of processing necessary. Accordingly, it became necessary to lengthen the radius of that annular area from about 5 feet up to around 6 to 10 feet and to double the beater capacity in order to provide for today's requirements of the amount of plucked fibers needed per unit of time. Doubling the number of bales from 20 to 40 in the annular area is possible upon an increase in the diameter of the outer circle from 22 feet to 28 feet.

Such changes caused some problems to develop in that merely doubling the number of rotary beaters did not prove satisfactory and in that the pull of the fibers from the bales by the longer length rotary beaters became non-uniform along the length of the beaters.

SUMMARY OF THE INVENTION

This invention overcomes those problems not only by using two rotary beaters but also by placing a divider between them so that they are effectively in separate chambers which have a common outlet. That outlet is connected, when in use, to a negative air pressure source through a transition which is so shaped and disposed (goosenecked) relative to the rotary beaters as to cause the velocity of air at the underside of the rotary beaters to be uniform throughout the length of the rotary beaters to within approximately 100 cfm. That causes the fibers on the various bales under the sweeping rotary beaters to be plucked much more uniformly across their radial direction. Additionally, the amount of fibers being plucked is increased significantly and the dual chambers feeding into a single outlet substantially improves the mixture of the fibers.

Another feature of this invention is that the outlet of the transition is delivered to a centrally-disposed hollow shaft for further delivery downstream to other processing equipment. Surrounding that hollow shaft or another hollow shaft holding a stationary electrical collector ring assembly which is associated with rotating brushes by which the required electrical contacts are made between the external and internal wiring.

BRIEF DESCRIPTION OF THE DRAWINGS

This invention will become more clear upon reading the detailed description which follows this brief description of the drawings, in which.

DETAILED DESCRIPTION OF THE INVENTION

Figure 1:
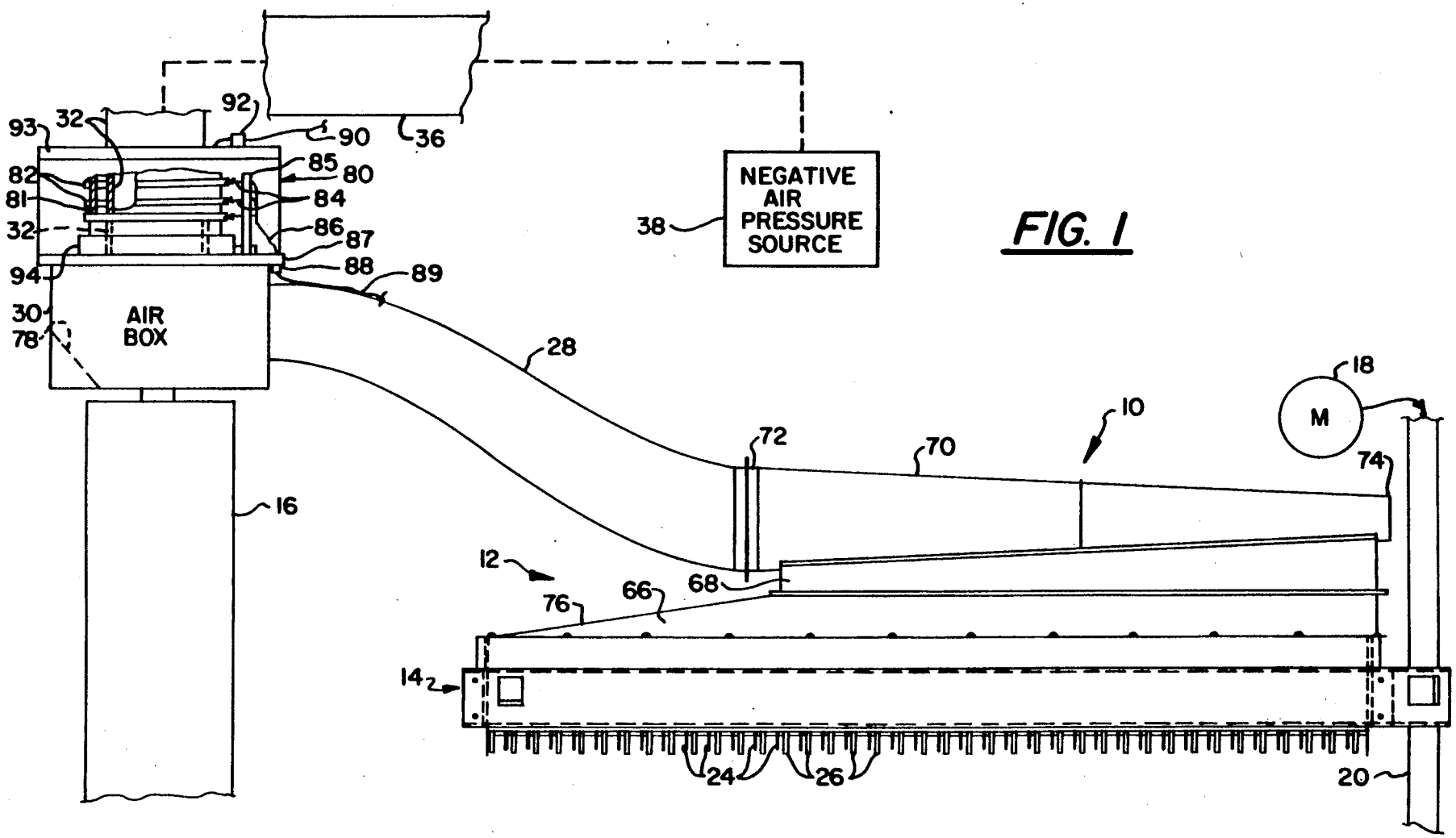
FIG. 1 is a general front elevational view, partially diagrammatic, of the equipment.

Parts of the textile fiber bale opener of which the present invention is a part can be similar to those described in the aforementioned U.S. Pat. No. 4,467,502 and hence are not described herein.

The rotary carriage or opening head 10 includes transition 12 and the rotary beater arrangement 14, all of which are movable around pylon 16 upon operation of motor 18 which drives a wheel (not shown) secured to frame leg 20. Head 10 may be rotably supported on pylon 16 by a boom (not shown) as in the above mentioned patent.

Figure 2:
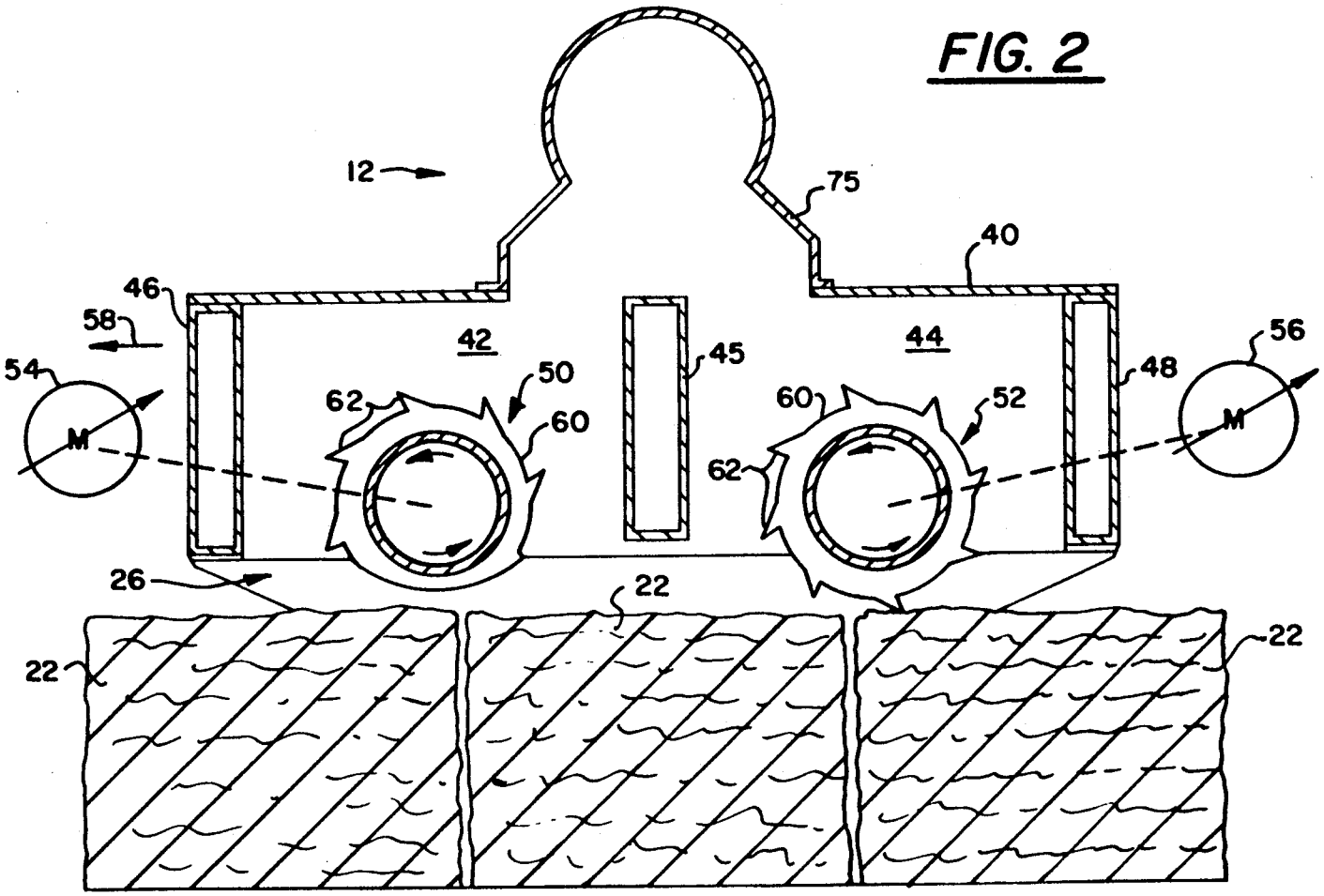
FIG. 2 is a transverse sectional view of a dual chamber rotary beater arrangement sweeping over fiber bales.

As carriage 10 is moved around pylon 16 the beater assembly 14 moves over fiber bales 22 as shown in FIG. 2. The bales are arranged in any desired layout, for example as shown in FIGS. 7–9 of the aforementioned U.S. Pat. No. 4,467,502, between inner and outer concentric circles centered on pylon 16. These circles make an annular area which is swept over by beater arrangement 14 as it is moved around pylon 16. The beater arrangement has spaced rotating pluckers 24, between each pair of which is located a grid bar which extends further downward for pressing down on the fiber bales while the pluckers 24 pluck fibers therefrom. Plucked fibers are drawn up into and out of transition 12 via flexible duct 28, air box 30, ducts 32 and 36 by a source 38 of negative air pressure.

Figure 4:
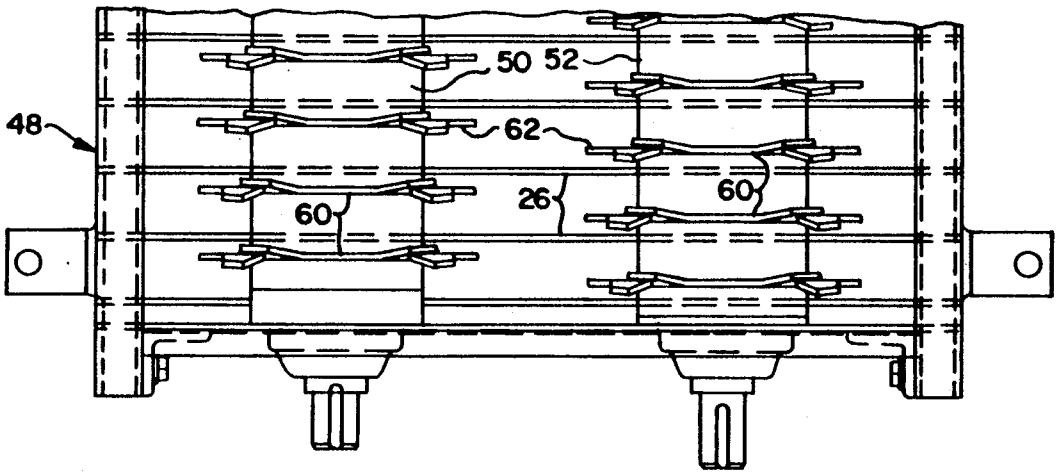
FIG. 4 is a partial plan view of the dual beaters and grids.
Figure 3:
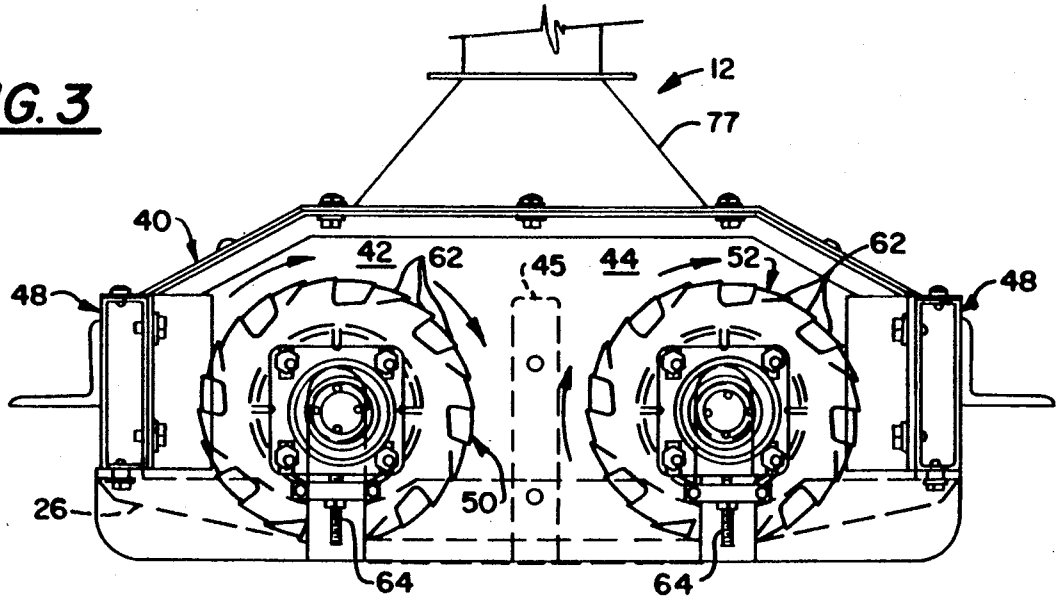
FIG. 3 is an end view of a dual chamber rotary beater arrangement.
Figure 5:
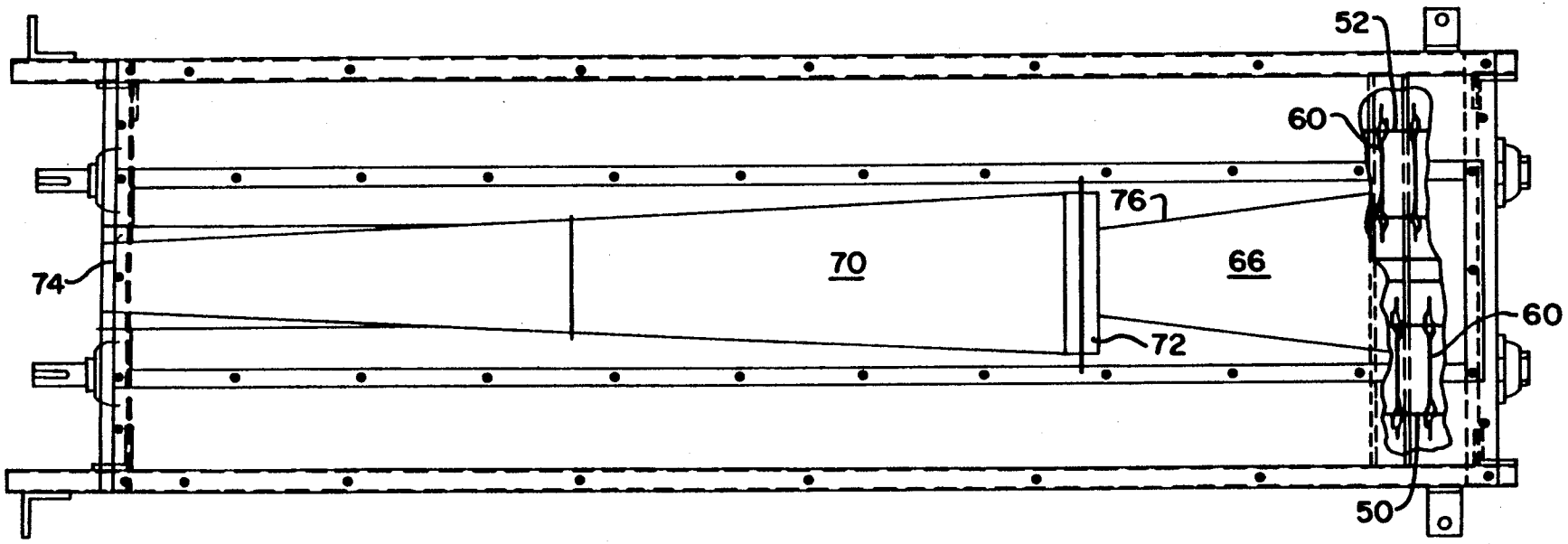
FIG. 5 is a top plan view of the transition and rotary beater arrangement.

The beater arrangement 14 may be constructed similar to that shown in FIGS. 2, 3 and 4.

In FIG. 2 the beater housing 40 has two chambers 42 and 44 formed by the central divider 45 and the respective end pieces 46 and 48. Disposed in chambers 42 and 44 are elongated, horizontally-extending rotary beaters or plucker rolls 50 and 52. Housing 40 extends the full length of the beater assembly 14, and so do chambers 42 and 44 along with plucker rolls 50 and 52. The plucker rolls are rotated by respective variable speed motors 54 and 56 so as to be independently controlled. Each plucker roll may be rotated in either direction, but as shown in FIG. 2 plucker rolls 50 and 52 rotate at their upper surface in the same direction as housing 40 is moved, as shown by arrow 58, by motor 18 in FIG. 1.

Each plucker roll includes a multiplicity of sawtooth blades 60 spaced along the length of the roll, each blade having a plurality of sawteeth 62 which dig into the fiber bales as the rolls are rotated while the carriage 10 is being rotated around pylon 16.

Disposed in between successive pairs of sawtooth blades on a roll are the grid bars 26 which as shown in FIGS. 2–4 extend the full width of housing 40.

As shown in FIG. 3, the sawteeth 62 may be staggered from one blade to the next for better plucking. Also, FIG. 3 shows for each of the plucker rolls 50 and 52 an adjustment 64 by which those rolls may independently be adjusted up and down. FIG. 4 shows that the sawtooth blades 60 for the respective plucker rollers 50 and 52 need not be in transverse alignment, but in fact are displaced longitudinally between a pair of grid bars 26.

As indicated previously, fibers plucked from bales 22 are pulled up through respective chambers 42 and 44 into a common outlet which includes transition 12. As shown in FIG. 1, transition 12 comprises three parts: hood 66, neck 68 and conical duct 70. The arrangement of transition 12 appears as a gooseneck, and has as its purpose the creation between grid bars 26 of a uniform velocity to within about 100 cfm along the full operative length of the plucker rollers 50 and 52 in beater assembly 14. It was found that when duct 70 was the full length of beater assembly 14, the velocity of the air being sucked up between grid bars 26 was not uniform along the length of the beater assembly, and hence fibers from bales especially at the outer end would not get sufficiently pulled out of the housing.

To cause uniform air velocity from end-to-end of the beater assembly 14, the large end 72 of the conical duct 70 is disposed between about one quarter and one half of the way from the inner end of the beater assembly to its outer end, while the outer end 74 of conical duct 70 is disposed more or less in line with the outer end of beater assembly 14. In other words, the length of conical duct 70 is between one half and three quarters the operative length of beater assembly 14. Conical duct 70 tapers from end-to-end with its diameter at the outer end 74 being less than about one half of its diameter at its inner end 72. On its underside, conical duct 70 has an opening communicating with neck 68 which generally has a rectangular shape and communicates with hood 66, the inner end 76 of which slopes from the inner end of neck 68 to the inner end of beater assembly 14. Otherwise, the front and back sides of hood 66 also slope from the neck frontwardly and backwardly to the beater assembly 14 either as shown at 75 in FIG. 2 or preferably as shown at 77 in FIG. 3 in order to collect the fibers from both chambers 42 and 44.

During operation the transition 12 is under a constant state of negative pressure of, for example, 6,000 cfm at end 72 of conical transition duct 70, which sucks the fibers plucked by the opening rolls 50 and 52 into the transition, and this airstream then carries the plucked fibers through the flexible duct 28, air box 30, ducts 32 and 36 on to the next processing equipment. The present invention allows for constant and equal pressure along the length of the beater assembly 14 and makes sure that the fiber that is plucked by the rolls goes into the airstream and to the next processing equipment. Also, this constant and equal pressure means that the feed off each bale caused by the plucker rolls is also constant and equal, which maintains a perfect blend of the plucked fibers.

Since each plucker roll has its own independent drive, its own separate chamber and can be independently moved upward or downward, each plucker roll is functionally independent of the other plucker roll. Since the transition 12 located above the plucker rolls is common to both, each plucker roll can maintain and deliver to the transition a constant even feed and the two constant even feeds are then combined in the transition 12 to deliver a superior blend of fiber characteristics to the next processing equipment.

Grid bars 26 which are disposed generally beneath the plucker rolls are at spacings of, for example, three inches. The sawtooth blades 60 on the plucker rolls are spaced centrally of the grid bars, and this arrangement allows the grid to put a downward pressure on the fiber in the bales. This holds the fiber stationary at three-inch intervals along the top of the bales, and the teeth pluck the fibers from in between the grids. The downward forces of the grids and the speed with which the sawteeth contact the fiber bales cause small tufts to be plucked from the bale. The multitude of resulting small tufts pass through the respective chambers 42 and 44 and into the common transition 12 of the head 10. The blending of fibers and of fiber characteristics is more efficient because there are greater quantities of smaller groups of fibers resulting from plucking by the equipment of this invention.

Since the carriage or opening head 10 and flexible duct 28 revolve around pylon 16, it is necessary for air box 30 to rotate therewith. Hence, air box 30 is rotably supported on pylon 16, and with the aid of its internal deflector 78 turns the airstream upward into metal ducting tube 32 through which it is pulled upwards and onward to duct 36 by the negative air pressure source 38.

Tube 32 is a part of the electrical collector ring assembly 80 which includes a hollow shaft 81 that carries a plurality of electrical collector rings 82. Shaft 81 spacedly surrounds tube 32. Associated with the collector rings are respective brushes 84 held by brush holder 85. The leads from brushes 84 are collected in a cable 86 which exits through a plate 87 to a wiring box 88 from which wires 89 extend along the flexible duct 28 to their respective switches, motors, etc. Power and control signals are brought to the equipment from an overhead cable 90 to wiring box 92 which is secured to plate 93. Wires from box 92 extend through plate 93 and downward through the space between the tube 32 and the inside of shaft 81 to respective ones of the collector rings to which they are fixedly secured.

Brush holder 85 is secured to plate 87 which revolves with air box 30, moving the brushes 84 around their respective collector rings when head 10 circles around pylon 16. A bearing 94 allows plate 87 to rotate while the collector ring shaft 81 and outlet duct 32 remain stationary.

Collector rings 82 and brushes 84 provide for the necessary electrical connections between the internal wiring and external wiring for operating the whole equipment. For example, there may be three collector rings for three phase operation plus one ring for ground, and several more rings for control purposes and interfacing with other equipment.

From the foregoing, it is clear that the present invention obviates the problems noted earlier and provides for a highly productive and efficient bale opener.

It was above indicated that an exemplary pressure at the large end 72 of conical transition 70 is 6000 cfm. Other exemplary perimeters of transition 12 are now given. Due to the conicity or taper of duct 70, there is a gradual pressure drop along its length, totally for example of 1000 cfm, which aids in causing the uniform velocity at grid bars 26 throughout the length of beater arrangement 14. In a specific arrangement, the diameter of duct 70 at its larger end 72 is 14 inches, and at its smaller, closed end 74 is six inches while its overall length is about 83 inches. Neck 68 is rectangular in plan view, six inches wide and 3.5 inches tall at its narrow end. Hood 66 is six inches tall for a length of approximately 78 inches and the slope 76 of the hood extends for about 40 inches. The overall operative length of beater assembly 14 is about 9.5 feet.

The foregoing parameters and description provide an operative embodiment of the invention, but it is to be understood that this invention is not limited by the foregoing but by the appended claims.

What is claimed is:

1. In a textile fiber bale opener of the type which includes rotary beater means movable over fiber bales, the improvement comprising:

said rotary beater means including two spaced rotatable, horizontally-disposed plucker rolls extending parallel to each other and perpendicular to a direction of movement of said rotary beater means over fiber bales, each of said plucker rolls having a multiplicity of circumferential sawtooth blades spaced along its length with each blade having a plurality of sawteeth disposed around its circumference, a housing for said rotary beater means including an interior space having a longitudinally-extending divider disposed in between said rolls for centrally dividing the space into two chambers respectively containing said plucker rolls, a multiplicity of grid bars respectively disposed between pairs of said sawtooth blades and extending below same for pressing down on fiber bales while said sawteeth pluck fibers from said bales, and output means including common duct means for pulling plucked fibers from said chambers concurrently into said duct means when connected to a source of negative air pressure.

2. Apparatus as in claim 1 wherein said duct means includes transition means having a given shape and disposition over said housing for creating a substantially uniform velocity of suction air at said grid bars along the whole length of said plucker rolls when said duct means is connected to said negative air pressure source.

3. Apparatus as in claim 2 and including means for rotating said beater means bodily about a vertical axis displaced from one end of said housing to cause said plucker rolls to sweep over fiber bales, electrical collector ring assembly means having centered on said vertical axis a stationary hollow shaft carrying a plurality of electrical collector rings and including brush means operative with said electrical collector rings and rotatable about said axis with said beater means for making external and internal wiring connections, and means connecting said transition means through said hollow shaft for conveying plucked fibers onwards.

4. Apparatus as in claim 2 wherein said housing has an upper opening extending the length of said plucker rolls, and wherein said transition means is goosenecked and includes a conical transition duct having a length between about half and three quarters the length of said housing opening and conically diverging from one end to its other end to which said source of negative air pressure is connected, said conical transition duct having a substantially full length opening on its underside, said transition means further including hood and neck means for transitionally connecting said housing and transition duct openings, the housing and transition duct extending parallel and the said one end of said transition duct being disposed substantially directly over one end of said housing, whereby said substantially uniform velocity of suction air is obtained.

5. Apparatus is in claim 4 wherein said one end of said conical transition duct has a diameter of less than half a diameter at its said other end.

6. Apparatus as in claim 4 wherein said hood and neck means includes a neck duct having a length about the same as said transition duct and connected thereto and a hood duct covering said housing opening and being connected to said neck and including a transition sloping from an end of said housing opposite to said one end thereof to said neck.

7. Apparatus as in claim 4 and including means for rotating said beater means bodily about a vertical axis displaced from an end opposite said one end of said housing to cause said plucker rolls to sweep over fiber bales, electrical collector ring assembly mans having centered on said vertical axis a stationary hollow shaft carrying a plurality of electrical collector rings and including brush means operative with said electrical collector rings and rotatable about said axis with said beater means for completing connections between external and internal wiring, and means connecting said transition means through said hollow shaft for conveying plucked fibers onwards.

8. In a textile fiber bale opener of the type which includes rotary beater means movable over fiber bales the improvement comprising:

said rotary beater means including rotatable, horizontally-disposed, rotary plucker roll means extending perpendicular to a direction of movement of said rotary beater means over fiber bales, said plucker roll means having a multiplicity of circumferentially disposed pluckers spaced along its length, a housing for said rotary plucker roll means, a multiplicity of grid bars transversely disposed between said pluckers and extending below same for pressing down on fiber bales while said pluckers pluck fibers from said bales, and output means including duct means for pulling plucked fibers from said housing into said duct means when connected to a source of negative air pressure, said duct means including transition means having a given shape and disposition over said housing for creating a substantially uniform velocity of suction air at said grid bars along the whole length of said plucker roll means when said duct means is connected to said negative air pressure source, said transition means including a conical transition duct disposed over said housing and having one end closed and conically diverging from said one end to an opposite end to which said source of negative air pressure is connectable.

9. Apparatus as in claim 8 and including means for rotating said plucker roll means bodily about a vertical axis displaced from one end of said housing to cause said plucker roll means to sweep over fiber bales, electrical collector ring assembly means having centered on said vertical axis a stationary hollow shaft carrying a plurality of electrical collector rings and including brush means operative with said electrical collector rings and rotatable about said axis with said plucker roll means for completing connections between external and internal wiring, and means connecting said transition means through said hollow shaft for conveying pluck fibers onwards.

10. Apparatus as in claim 8 wherein said housing has an upper opening extending the length of said plucker roll means, and wherein said transition means is goosenecked and said conical transition duct has a length between about half and three quarters the length of said housing opening, said conical transition duct having a substantially full length opening on its underside, said transition means further including hood and neck means for transitionally connecting said housing and transition duct openings, the housing and transition duct extending parallel and the said one end of said transition duck being disposed substantially directly over one end of said housing, whereby said substantially uniform velocity of suction air is obtained.

11. Apparatus as in claim 8 wherein said one end of said conical transition duct has a diameter of less than half of diameter at its said opposite end.

12. Apparatus as in claim 10 wherein said hood and neck means includes a neck duct having a length about the same as said transition duct and connected thereto and a hood duct covering said housing opening and being connected to said neck and including a transition sloping from an end of said housing opposite to said one end thereof to said neck.

13. Apparatus as in claim 10 and including means for rotating said beater means about a vertical axis displaced from an end opposite said one end of said housing to cause said plucker rolls to sweep over fiber bales, electrical collector ring assembly means having centered on said vertical axis a stationary hollow shaft carrying a plurality of electrical collector rings and including brush means operative with said electrical collector rings and rotatable about said axis with said beater means for completing wiring connections, and means connecting said transition means through said hollow shaft for conveying plucked fibers onwards.

14. In a textile fiber bale opener of the type which includes rotary beater means movable circularly over fiber bales, the improvement comprising:

said rotary beater means including rotatable, horizontally-disposed, rotary plucker roll means extending perpendicular to a direction of movement of said rotary beater means over fiber bales, said plucker roll means having a multiplicity of circumferentially disposed pluckers spaced along its length, a housing for said rotary plucker roll means, a multiplicity of grid bars transversely disposed between said pluckers and extending below same for pressing down on fiber bales while fibers are plucked from said bales by said pluckers, output means including duct means for pulling plucked fibers from said housing into said duct means when connected to a source of negative air pressure, means for rotating said plucker roll means bodily about a vertical axis displaced from one end of said housing to cause said plucker rolls to move over fiber bales, electrical collector ring assembly means having centered on said vertical axis a stationary hollow shaft carrying a plurality of collector rings and including brush means operative with said electrical collector rings and rotatable with said plucker roll means for completing wiring connections, and means connecting said duct means through said hollow shaft for conveying plucked fibers onwards.

15. Apparatus as in claim 14 wherein said duct means includes transition means having a given shape and disposition over said housing for creating a substantially uniform velocity of suction air at said grid bars along the whole length of said plucker rolls when said duct means is connected to said negative air pressure source.

16. Apparatus as in claim 15 wherein said housing has an upper opening extending the length of said plucker rolls, and wherein said transition means is goosenecked and includes a conical transition duct having a length between about half and three quarters the length of said housing opening and conically diverging from one end of its other end to which said source of negative air pressure is connected, said conical transition duct having a substantially full length opening on its underside, said transition means further including hood and neck means for transitionally connecting said housing and transition duct openings, the housing and transition duct extending parallel and the said one end of said transition duct being disposed substantially directly over one end of said housing, whereby said substantially uniform velocity of suction air is obtained.

17. Apparatus as in claim 16 wherein said one end of said conical transition duct has a diameter of less than half a diameter at its said other end.

18. Apparatus as in claim 16 wherein said hood and neck means includes a neck duct having a length about the same as said transition duct and connected thereto and a hood duct covering said housing opening and being connected to said neck and including a transition sloping from an end of said housing opposite to said one end thereof to said neck.

19. Apparatus as in claim 15 wherein said plucker roll means includes two plucker rolls, said housing has an interior space in which is a longitudinally-extending divider for centrally dividing said space into two chambers respectively containing said plucker rolls, and said duct means is common to said two chambers for pulling fibers from both chambers concurrently.

* * * * *